US012544645B2

(12) United States Patent
O'Brien

(10) Patent No.: US 12,544,645 B2
(45) Date of Patent: Feb. 10, 2026

(54) GOLF GLOVE

(71) Applicant: Conor O'Brien, Dublin (IE)

(72) Inventor: Conor O'Brien, Dublin (IE)

( * ) Notice: Subject to any disclaimer, the term of this patent is extended or adjusted under 35 U.S.C. 154(b) by 0 days.

(21) Appl. No.: 18/289,244

(22) PCT Filed: May 3, 2022

(86) PCT No.: PCT/EP2022/061838
§ 371 (c)(1),
(2) Date: Nov. 2, 2023

(87) PCT Pub. No.: WO2022/233862
PCT Pub. Date: Nov. 10, 2022

(65) Prior Publication Data

US 2024/0424381 A1 Dec. 26, 2024

(30) Foreign Application Priority Data

May 5, 2021 (GB) ..... 2106415

(51) Int. Cl.
*A63B 71/14* (2006.01)
*A41D 19/015* (2006.01)

(52) U.S. Cl.
CPC ..... *A63B 71/146* (2013.01); *A41D 19/01523* (2013.01); *A41D 19/01582* (2013.01); *A41D 2600/10* (2013.01); *A63B 2209/02* (2013.01)

(58) Field of Classification Search
CPC . A63B 71/141; A63B 71/146; A63B 2209/02; A41D 19/01523; A41D 19/01547; A41D 19/01564; A41D 19/01582; A41D 2600/10; A41D 13/088; A41D 19/015
See application file for complete search history.

(56) References Cited

U.S. PATENT DOCUMENTS 4,691,387 A * 9/1987 Lopez ..... A63B 71/141 2/160
4,882,787 A * 11/1989 Hull ..... A63B 71/146 2/163
5,214,799 A * 6/1993 Fabry ..... A41D 19/01523 2/917
5,500,956 A * 3/1996 Schulkin ..... A63B 71/148 2/161.3

(Continued)

FOREIGN PATENT DOCUMENTS

CH 667397 A5 * 10/1988 ..... A63B 71/148
WO 2006047642 A2 5/2006

OTHER PUBLICATIONS

Nov. 18, 2021 Search Report in corresponding Application No. GB 2106415.9.

(Continued)

*Primary Examiner* — Aiying Zhao
(74) *Attorney, Agent, or Firm* — Vitale, Vickrey, Niro, Solon & Gasey LLP

(57) ABSTRACT

A golf glove 10 comprising a glove portion 11 configured to conform generally to the anatomy of the hand and a support layer 12 configured to protect at least portions of the wrist and/or hand from forces exerted thereon during a golf swing. The support layer is sized, dimensioned and located to protect the Carpal Tunnel, Guyon's Canal, Extensor Carpi Ulnaris Tendon, Triangular Fibrocartilage, Palmar Aponeurosis, and the Hamate Bone.

8 Claims, 3 Drawing Sheets

(56) References Cited

U.S. PATENT DOCUMENTS

| | | | | |
|---|---|---|---|---|
| 5,581,809 | A * | 12/1996 | Mah | A41D 19/01523 2/161.1 |
| 6,098,200 | A * | 8/2000 | Minkow | A41D 19/01523 2/161.1 |
| 6,230,524 | B1 | 5/2001 | Kolmes | |
| 6,845,514 | B1 * | 1/2005 | Yao | A61F 13/104 128/878 |
| 2002/0100105 | A1 | 8/2002 | Terris | |
| 2003/0061651 | A1 | 4/2003 | Derose | |
| 2007/0022512 | A1 * | 2/2007 | Coulter | A63B 71/141 2/161.1 |
| 2009/0144880 | A1 * | 6/2009 | Desjardin | A41D 31/14 2/163 |
| 2012/0316485 | A1 | 12/2012 | Fryda | |
| 2013/0281234 | A1 | 10/2013 | Ramirez | |
| 2020/0077723 | A1 | 3/2020 | Hyland | |

OTHER PUBLICATIONS

Sep. 5, 2022 International Search Report and Written Opinion in corresponding Application No. PCT/EP2022/061838.

* cited by examiner

GOLF GLOVE

This patent application is a 35 U.S.C 371 national stage application of International Patent Application No. PCT/BP2022/061838, filed on May 3, 2022, which claims priority to GB Application No. 2106415.9, filed on May 5, 2021. All of these disclosures are hereby expressly incorporated by reference as part of the present disclosure as if fully set forth herein.

FIELD OF THE INVENTION

This invention relates to a golf glove and in particular to a golf glove for reducing injury to the hand and wrist whilst playing golf.

BACKGROUND OF THE INVENTION

Golf injury in general is common, with on average seven of ten amateur and nine of ten professional golfers experiencing an injury during their playing career. Moreover, injury rates relating to golf participation has increased in the past 15 years. This is primarily due to three factors: (1) increased population participation, (2) changes in golf equipment allowing greater swing speeds, and (3) new teaching practices and techniques which place the leading wrist and hand under new and extreme forces resulting in injury. Leading wrist injury is now the most common anatomical site of injury in the golfing population. These leading wrist injuries encompass both Musculoskeletal and neurological structures. Currently available golf gloves comprise padding placed over the pad of the thenar eminence and over the hypothenar eminence. This formation of padding is over 50 years old, and was created to account for a neutral grip and that the more traditional golf swing was based on a cocking and un-cocking motion. The current golf swing favours a stronger grip, a shut face at the top of the back swing and a delayed release of energy on the down swing. Current golf gloves do not take these elements into account and therefore do not provide sufficient support in key areas.

In the past 10 years there have been some efforts to create golf gloves that protect painful and/or arthritic hands. These gloves have been non-conforming to the rules of the R & A and the USGA and therefore cannot be deployed in competitive golf. Other alliterations have proven to be cumbersome and incongruous to the normal functioning of a golf swing.

It is desirable to provide a golf glove that provides protection from injury yet complies with the regulations set by official golfing bodies.

SUMMARY OF THE INVENTION

According to the invention there is provided a golf glove comprising a glove portion configured to conform generally to at least a portion of the anatomy of the hand and a support layer configured to protect at least portions of the wrist and/or hand from forces exerted thereon during a golf swing, the support layer being sized, dimensioned and/or located to protect one or more of the Carpal Tunnel, Guyon's Canal, Extensor Carpi Ulnaris Tendon, Triangular Fibrocartilage, Palmar Aponeurosis, and/or the Hamate Bone.

Preferably, the glove portion comprises individual sleeves for each finger and thumb.

Ideally, the glove portion comprises a palmer surface, a dorsal surface, an ulnar side, a radial side, first to fifth digit portions, and a wrist portion which, in use, conform generally and align with the palmer surface, dorsal surface, ulnar side, radial side, first to fifth digits and wrist of a hand placed therein.

Preferably, the support layer extends generally across the palmer surface of the glove portion from the radial side thereof to the ulnar side thereof.

Ideally, the support layer comprises a palmer border which extends generally across the palmer surface of the glove portion.

Preferably, the palmer border extends in an oblique fashion.

Ideally, the palmer border extends in an oblique fashion from at or about the base of the glove at the radial side thereof, or the wrist portion, towards the fifth digit/small finger portion.

Preferably, the support layer covers the portion of the glove below the palmer border.

Ideally, in use, the palmer border extends generally across the palmer surface of the glove portion in an oblique fashion from at or about the proximal wrist crease adjacent the thumb to a location at or about the base of proximal phalange of the fifth digit/small finger.

Preferably, the support layer covers the portion of the glove between the palmer border and the base of the glove.

Ideally, the support layer extends around the ulnar side of the glove portion.

Preferably, the support layer extends around the ulnar side of the glove portion and towards the dorsal surface of the glove portion.

Preferably, an ulnar stitch line is located generally along the ulnar side of the golf glove.

Ideally, the ulnar stitch line extends from generally proximal the base of the glove towards the distal end of the glove.

Preferably, the support layer extends across the ulnar stitch line form the palmer surface of the glove portion to the dorsal surface thereof.

Ideally, the support layer comprises a single or variable thickness, the thickness being no more than 0.635 mm at any location on the support layer.

Preferably, the support layer comprises a first portion extending from a first end thereof at the base of the glove portion towards the distal end of the glove portion to a second end of the first portion.

Ideally, the first portion has a first thickness at its first end and a second thickness at its second end, the second thickness being larger than the first thickness.

Preferably, the first portion of the support layer comprises a rise or ramped portion whereat the thickness of the first portion of the support layer is gradually increased so as to transition between the first thickness and the second thickness.

Ideally, the first thickness is approximately 0.5 mm.

Preferably, the second thickness is approximately 0.635 mm.

Ideally, the second thickness is no more than 0.635 mm.

Preferably, the rise or ramped portion is proximal the first end of the first portion of the support layer and extends approximately 3 mm therefrom.

Preferably, the support layer comprises a second portion.

Ideally, the second portion of the support layer is located such that it extends, in use, over the hook of the hamate bone of the hand and the lateral aponeurosis and flexor tendons to digit 4 and digit 5 thereof.

Preferably, the second portion of the support layer comprises first and second ends.

Ideally, the first end of the second portion of the support layer extends from the second end of the first portion of the support layer.

Preferably, the second portion of the support layer comprises a constant thickness of approximately but not more than 0.635 mm.

Ideally, the support layer comprises a third portion.

Preferably, the third portion of the support layer extends from the second end of the second portion of the support layer Ideally, the third portion of the support layer extends around the ulnar side of the glove portion towards the dorsal surface thereof.

Preferably, the third portion of the support layer extends across the ulnar stitch line form the palmer surface of the glove portion to the dorsal surface thereof.

Ideally, the third portion of the support layer extends around the ulnar side of the glove portion and approximately 2 mm onto the dorsal surface of the glove portion Preferably, the third portion of the support layer comprises a thickness of approximately but not more than 0.635 mm.

Ideally, the ulnar stitch line is reinforced with an overlock, mattress and lattice type stitching pattern.

Preferably, the ulnar stitch line comprises a combination of reinforced injected composite yarn selected from, for example, Gortex, E-glass, Basalt and Carbon.

Ideally, the ulnar stitch line is formed externally of the support layer.

Ideally, the first, second, and third portions of the support layer are formed as a unitary layer.

Alternatively, the first, second, and third portions of the support layer may be formed as separate layers.

Preferably, the support layer is attached to the glove portion by any suitable means such as but not limited to stitching, adhesive bonding, or fabric welding.

Alternatively, the support layer may be formed within the glove portion, for example the glove portion may comprise a plurality of layers and the support layer may be formed between two layers of the glove portion.

According to a second aspect of the invention there is provided a method of manufacturing a golf glove comprising the steps of: forming a glove portion, forming a support layer, attaching the support layer or integrating said support layer into the glove portion such that the support layer is sized, dimensioned and/or located to protect one or more of the Carpal Tunnel, Guyon's Canal, Extensor Carpi Ulnaris Tendon, Triangular Fibrocartilage, Palmar Aponeurosis, and/or the Hamate Bone.

Ideally, the method comprising the steps attaching or integrating the support layer such that it extends generally across the palmer surface of the glove portion from the radial side thereof to the ulnar side thereof.

Preferably, the method comprising the step of, by attaching or integrating the support layer, forming a palmer border which extends generally across the palmer surface of the glove portion in an oblique fashion from at or about the base of the glove at the radial side thereof, or the wrist portion, towards the fifth digit/small finger portion, preferably the support layer covering the portion of the glove below the palmer bear

BRIEF DESCRIPTION OF THE DRAWINGS

An embodiment of the invention is now described by way of example and with reference to the accompanying drawings in which.

DETAILED DESCRIPTION OF THE DRAWINGS

Figure 1:
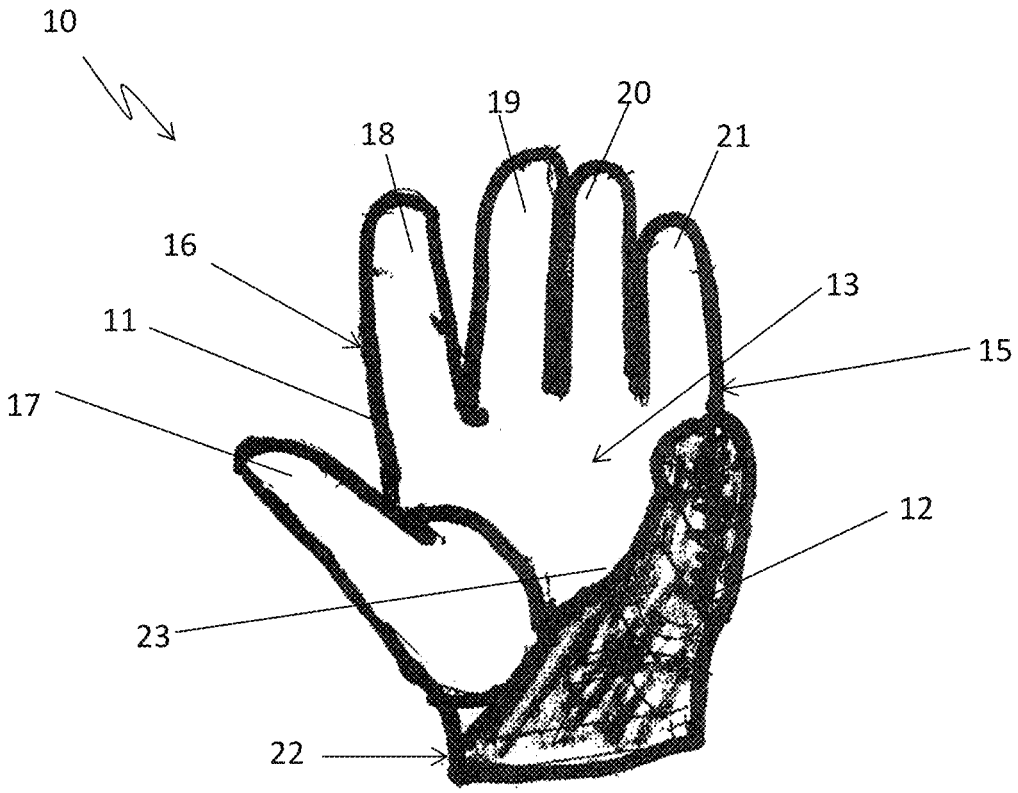
FIG. 1 is a perspective view of an embodiment of a golf glove showing the palmer side surface of the glove.

The present teaching will now be described with reference to an exemplary golf glove. It will be understood that the exemplary golf glove is provided to assist in an understanding of the present teaching and are not to be construed as limiting in any fashion. Furthermore, elements or components that are described with reference to any one Figure may be interchanged with those of other Figures or other equivalent elements without departing from the spirit of the present teaching.

Referring now to the Figures there is illustrated a golf glove 10 comprising a glove portion 11 configured to conform generally to the anatomy of the hand and a support layer 12 configured to protect at least portions of the wrist and/or hand from forces exerted thereon during a golf swing. The support layer is sized, dimensioned and located to protect the Carpal Tunnel, Guyon's Canal, Extensor Carpi Ulnaris Tendon, Triangular Fibrocartilage, Palmar Aponeurosis, and the Hamate Bone. Advantageously, this provides support/protection of the portions of the hand and wrist which experience significant stress during the motion of a modern golf swing. The glove portion comprises a palmer surface 13, a dorsal surface 14, an ulnar side 15, a radial side 16, first to fifth digit portions 17, 18, 19, 20, 21 and a wrist portion 22 which, in use, conform generally and align with the palmer surface, dorsal surface, ulnar side, radial side, first to fifth digits and wrist of a hand placed therein. For clarity, the ulnar side of the hand is herein defined as the side having the fifth digit/small finger 21 and the radial side is the side of the hand having the first digit/thumb 17. The palmer surface 13 is defined as the surface of side of the hand which comprises the palm and the dorsal surface 14 is the opposing surface, or more generally the back of the hand. The first to fifth digits 1, 18, 19, 20, 21 are sequentially numbered starting with the thumb 17 and ending with the small finger 21. The glove portion 11 may, for example, take the form of a known standard golf glove.

The support layer 12 extends generally across the palmer surface 13 of the glove portion 11 from the radial side 16 thereof to the ulnar side 15 thereof and forms a palmer & border 23 which extends generally across the palmer surface 13 of the glove portion 11. The palmer border is the line defined by the edge of the support layer 12. The palmer border 23 extends in an oblique fashion from the base 24 of the glove at the radial side 16 thereof towards the fifth digit/small finger portion. The support layer 12 covers the portion 25 of the glove below the palmer border 23 which is the area in which the aforementioned anatomical features of the hand and wrist which experience significant stress during the golf swing are located. In use, the palmer border 13 extends generally across the palmer surface 13 of the glove portion in an oblique fashion from at or about the proximal wrist crease adjacent the thumb 17 to a location at or about the base of proximal phalange 26 of the fifth digit/small finger 21. The support layer 12 covers the portion of the glove 25 between the palmer border 23 and the base of the glove 24. As can be seen in FIG. 1, the support layer 12 may take a pistol shaped form having a wider base portion which tapers towards the fifth digit/small finger 21. The support layer 12 may also comprise a fan shaped form which again exhibits a tapered shape towards the fifth digit/small finger. In general, the support layer covers the lower right section of the palmer surface 13, being defined as the section below the palmer border 23, or alternatively, the section below a line extending generally between an area below the thumb/first digit portion 17 to at or about the base of the fifth digit 21. Advantageously, the aforementioned shape of the support layer 12 takes into account the anatomical structure of the Carpal Tunnel where nine tendons, blood vessels, and the median nerve traverse on their way through the wrist into the hand. More specifically, the shape of the support layer takes account of the width, depth, and tilt angle of the Carpal Tunnel. The Carpal Tunnel tilts from the radial side of the hand towards the ulnar side and has varying width and depth, hence the support layer comprises the herein recited shape, positioning and varying thickness to facilitate effective support of the Carpal Tunnel during the golf swing. It should be understood that mention of these specific shapes for the support layer 12 are not intended to be limiting in any fashion, the key aspect is that the support layer generally traverses across the palmer surface from the lower area below the thumb 17 upwards and towards the fifth digit/small finger 21. The palmer bears 23 formed by the support layer 12 may travel in a linear fashion, a curved fashion, or in an irregular fashion across the palmer surface 13. The support layer 12 comprises a single or variable thickness, the thickness being no more than 0.635 mm at any location on the support layer 12. Advantageously, the support layer may comply with the regulations in regards to golf gloves as set by the Royal and Ancient (R&A) and United States Golf Association (USGA) golfing bodies which stipulate a maximum padding thickness of 0.635 mm.

Figure 2:
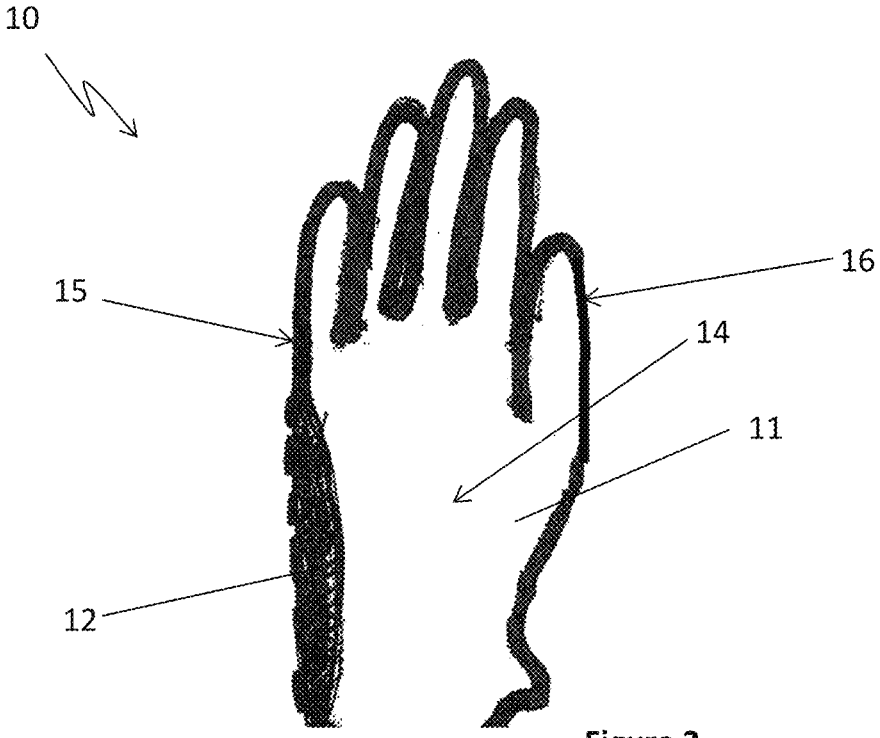
FIG. 2 is a perspective view of the dorsal side of the glove of FIG. 1.
Figure 3:
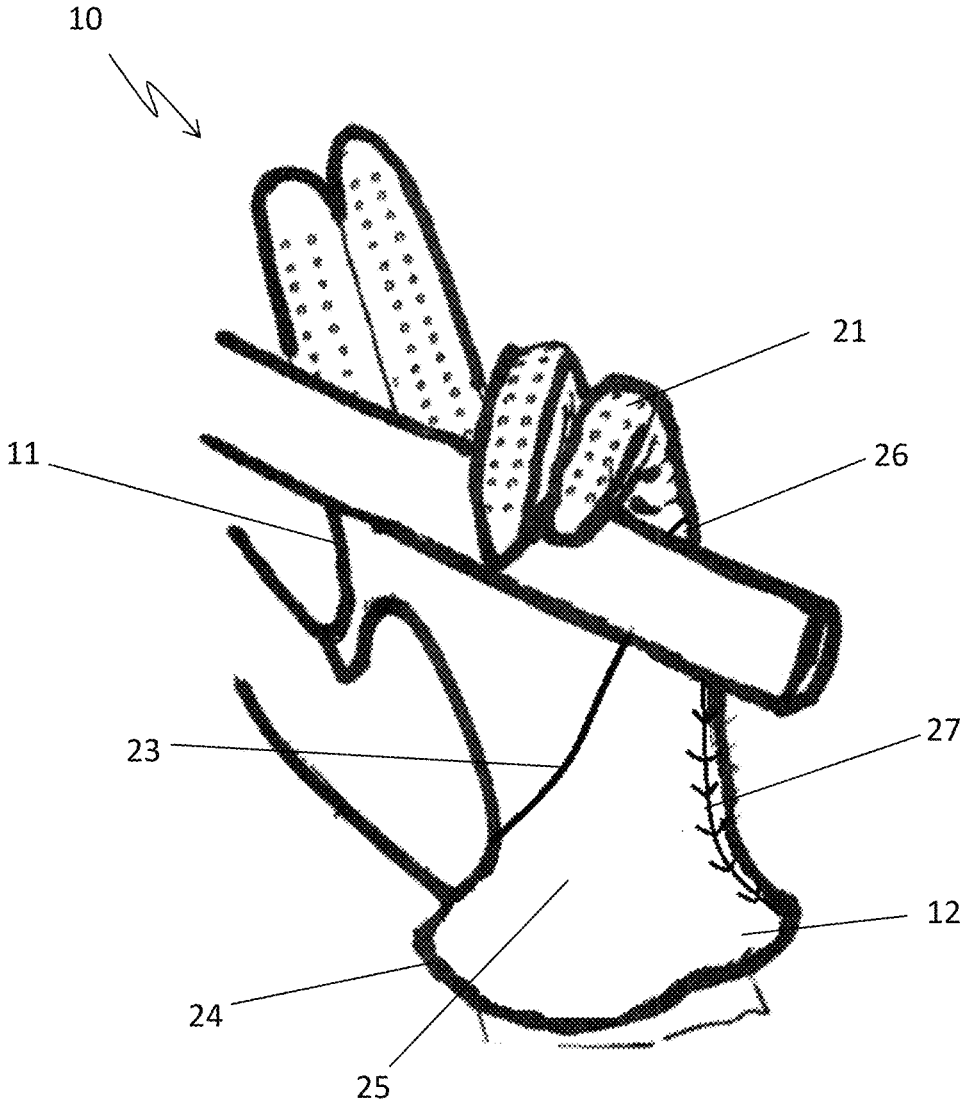
FIG. 3 is a perspective view of the golf glove of FIG. 1 in use.
Figure 4:
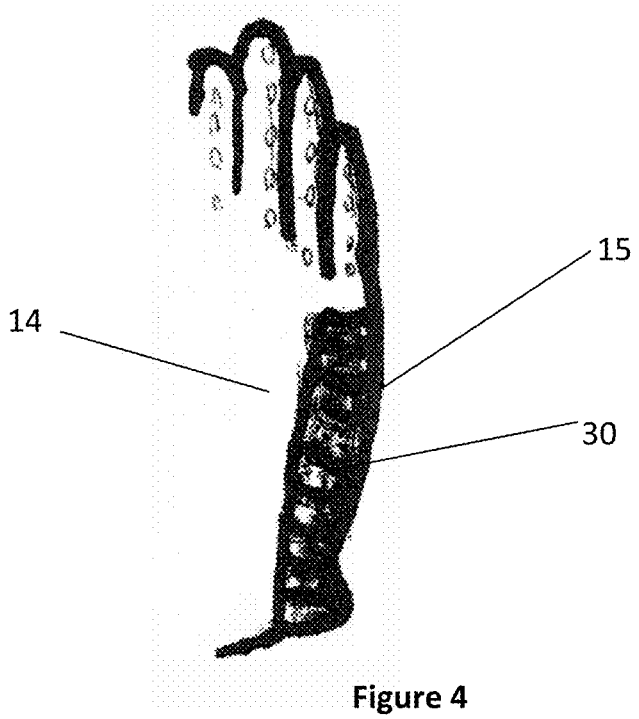
FIG. 4 is a perspective view of the ulnar side of the golf glove of FIG. 1.

In a preferred embodiment, and is best seen in FIG. 2, the support layer 12 extends around the ulnar side 15 of the glove portion 11 and towards the dorsal surface 14 of the glove portion 11. An ulnar stitch line 27 is located generally along the ulnar side 15 of the golf glove 10 which extends from the base 24 of the glove towards the distal end of the glove. The support layer 12 extends across the ulnar stitch line 27 form the palmer surface 13 of the glove portion to the dorsal surface 14 thereof.

Figure 5:
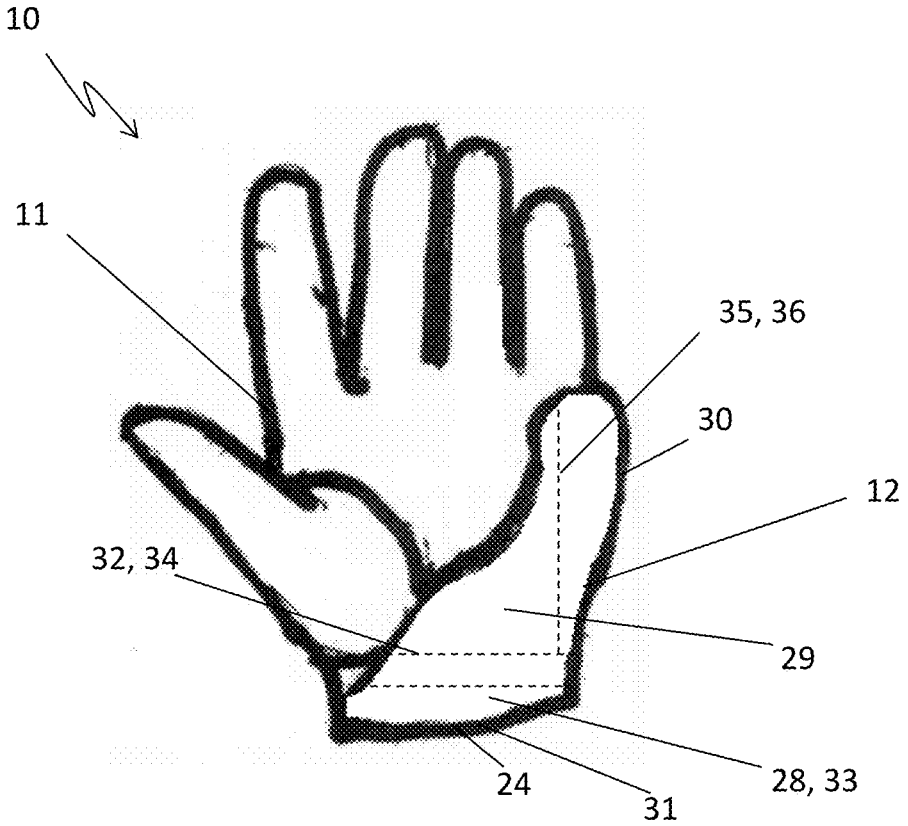
FIG. 5 is a perspective view of the golf glove of FIG. 1 showing portions of a support layer thereof.

As is best viewed in FIG. 5, the support layer comprises a first portion 28 extending from a first end 31 thereof at the base 24 of the glove portion 11 towards the distal end of the glove portion 11 to a second end 32 of the first portion 28. The first portion 28 has a first thickness at its first end 31 and a second thickness at its second end 32, the second thickness being larger than the first thickness. The first portion 28 of the support layer 12 further comprises a rise or ramped portion 33 whereat the thickness of the first portion 28 is gradually increased so as to transition between the first thickness and the second thickness thereof. In a preferred embodiment, the first thickness is approximately 0.5 mm and the second thickness is approximately 0.635 mm, but no more than 0.635 mm. The rise or ramped portion 33 is at the first end 31 of the first portion 28 of the support layer 12 and in a preferred embodiment extends approximately 3 mm therefrom. Thereafter, the thickness of the first portion is maintained at the second thickness until the second end 32 of the first portion 28. The first portion 28 protects the Carpal Tunnel and the lateral and central palmar aponeurosis. By virtue of the rise or ramped portion 33, the first portion 28 of the support layer 12 is sized, shaped, and dimensioned to take into account of the cone-like shape of the Carpal Tunnel and its tilt angle.

The support layer 12 comprises a second portion 29 which is located such that it extends, in use, over the hook of the hamate bone of the hand and over the lateral aponeurosis and flexor tendons to digit 4 and digit 5 of the hand. Advantageously, the second portion 29 of the support layer 12 protects these anatomical features from damage during the golf swing. The second portion 29 of the support layer 12 comprises first and second ends 34, 35. The first end 34 of the second portion of the support layer extends from the second end 32 of the first portion 28 of the support layer 12. As can be seen from FIG. 5, the second end 32 of the first portion 28 and the first end 34 of the second portion 29 are co-located. In a preferred embodiment, the first and second portions 28, 29 are formed as a unitary component such that a seamless transition exists therebetween. The second portion 29 of the support layer comprises a constant thickness of approximately but not more than 0.635 mm.

The support layer comprises a third portion 30 extending from the second end 35 of the second portion 29 of the support layer 12 and around the ulnar side 15 of the glove portion 11 towards the dorsal surface 14 thereof. The third portion 30 of the support layer 12 extends across the ulnar stitch line 27 form the palmer surface 13 of the glove portion to the dorsal surface 14 thereof, and approximately 2 mm onto the dorsal surface 14. In a preferable embodiment, the third portion 30 of the support layer 12 comprises a thickness of approximately but not more than 0.635 mm. As can be seen from FIG. 5, the second end 35 of the second portion 29 and a first end 36 of the third portion 30 are co-located. In a preferred embodiment, the second and third portions 29, 30 are formed as a unitary component such that a seamless transition exists therebetween.

The ulnar stitch line is reinforced with an overlock, mattress and lattice type stitching pattern, the stitching preferably comprising a combination of reinforced injected composite yarn selected from, for example, Gortex, E-glass, Basalt and Carbon. This ensures waterproofing, durability and tensile strength In the preferred embodiment, the first, second, and third portions 28, 29, 20 of the support layer 12 are formed as a unitary and continuous layer. However, it should be understood that the first, second, and third portions 28, 29, 30 may be formed as separate portions and assembled at the aforementioned locations on the glove portion 11 to form the overall support layer 12. The support layer 12 is attached to the glove portion by any suitable means such as but not limited to stitching, adhesive bonding, or fabric welding. The skilled person would be well aware of a plurality of methods for attaching further padding/support element to a glove. In an alternative embodiment, the support layer 12 may be formed within the glove portion 11, for example the glove portion may comprise a plurality of layers and the support layer 12 may be formed/disposed between two layers of the glove portion.

In preferable embodiments, the support layer is formed from a combination of leather (such as Cabretta), synthetic leather like material (such as Serrano) or a combination of leather and synthetic materials. The skilled person would be well aware of multiple materials that may be utilised to form a support layer.

The invention is not limited to the embodiment(s) described herein but can be amended or modified without departing from the scope of the present invention.

The invention claimed is:

1. A golf glove comprising:

a glove portion configured to conform to at least a portion of the anatomy of a wearer's hand, the golf glove further comprising a support layer configured to protect at least portions of the wearer's wrist and/or hand from forces exerted thereon during a golf swing, the support layer being sized, dimensioned and/or located to protect one or more of the Carpal Tunnel, Guyon's Canal, Extensor Carpi Ulnaris Tendon, Triangular Fibrocartilage, Palmar Aponeurosis, and/or the Hamate Bone of the wearer, wherein the support layer extends across a palmer surface of the glove portion from a radial side thereof to an ulnar side thereof, wherein the support layer comprises a palmer border which extends across the palmer surface of the glove portion in an oblique fashion from at or about a base of the glove at the radial side thereof, or a wrist portion, towards a fifth digit/small finger portion, the support layer covering a portion of the glove below the palmer border, wherein, in use, the palmer border extends across the palmer surface of the glove portion in an oblique fashion from at or about a proximal wrist crease adjacent the wearer's thumb to a location at or about a base of a proximal phalange of the wearer's fifth digit/small finger, the support layer covering the portion of the glove between the palmer border and the base of the glove, wherein an ulnar stitch line is located generally along the ulnar side of the golf glove and extends from generally proximal the base of the glove towards a distal end of the glove, and the support layer extends across the ulnar stitch line form the palmer surface of the glove portion to the dorsal surface thereof, wherein the thickness of the support layer is no more than 0.635 mm at any location on the support layer, wherein the support layer comprises a first portion extending from a first end thereof at the base of the glove portion towards the distal end of the glove portion to a second end of the first portion, the first portion having a first thickness at its first end and a second thickness at its second end, the second thickness being larger than the first thickness, wherein the first portion of the support layer comprises a rise or ramped portion whereat the thickness of the first portion of the support layer is gradually increased so as to transition between the first thickness and the second thickness, and a second portion, the second portion being located such that it extends, in use, over a hook of the hamate bone of the hand and lateral aponeurosis and flexor tendons to digit 4 and digit 5 thereof, wherein the second portion comprises first and second ends and the first end of the second portion of the support layer extends from the second end of the first portion of the support layer, wherein the second portion of the support layer comprises a constant thickness of not more than 0.635 mm, and a third portion, the third portion extending from the second end of the second portion of the support layer and extending around the ulnar side of the glove portion towards the dorsal surface thereof.

2. The golf glove of claim 1 wherein the support layer extends around the ulnar side of the glove portion towards a dorsal surface of the glove portion.

3. The golf glove of claim 1 wherein the first thickness is 0.5 mm and the second thickness is no more than 0.635 mm.

4. The golf glove of claim 1, wherein the rise or ramped portion is proximal the first end of the first portion of the support layer and extends 3 mm from the proximal end of the rise or ramped portion.

5. The golf glove of claim 1 wherein the third portion extends across an ulnar stitch line from the palmer surface of the glove portion to a dorsal surface thereof.

6. The golf glove of claim 1, wherein the third portion extends around the ulnar side of the glove portion and 2 mm onto the dorsal surface of the glove portion.

7. The golf glove of claim 1, wherein the first, second, and third portions of the support layer are formed as a unitary layer.

8. The golf glove of claim 1, wherein the ulnar stitch line comprises a combination of reinforced injected composite yarn selected from E-glass, Basalt and Carbon.

* * * * *